US010287089B2

(12) United States Patent
Witwer et al.

(10) Patent No.: US 10,287,089 B2
(45) Date of Patent: May 14, 2019

(54) DRUM FOR STORAGE AND TRANSPORTATION OF ARTICLES AND MATERIALS

(71) Applicants: Direct Wire & Cable, Inc., Denver, PA (US); Richard Witwer, Lancaster, PA (US); Seth Galewyrick, Victor, MT (US); Howard Finley Livingston, Lancaster, PA (US); Andrew Weiman, Langhorne, PA (US)

(72) Inventors: Richard Witwer, Lancaster, PA (US); Seth Galewyrick, Victor, MT (US); Howard Finley Livingston, Lancaster, PA (US); Andrew Weiman, Langhorne, PA (US)

(73) Assignee: Direct Wire & Cable, Inc., Denver, PA (US)

( * ) Notice: Subject to any disclaimer, the term of this patent is extended or adjusted under 35 U.S.C. 154(b) by 0 days.

(21) Appl. No.: 15/569,857

(22) PCT Filed: Apr. 27, 2016

(86) PCT No.: PCT/US2016/029496

§ 371 (c)(1),
(2) Date: Oct. 27, 2017

(87) PCT Pub. No.: WO2016/176289

PCT Pub. Date: Nov. 3, 2016

(65) Prior Publication Data

US 2018/0111748 A1 Apr. 26, 2018

Related U.S. Application Data

(60) Provisional application No. 62/153,056, filed on Apr. 27, 2015.

(51) Int. Cl.
*B65D 85/04* (2006.01)
*B65D 71/00* (2006.01)
(Continued)

(52) U.S. Cl.
CPC ..... *B65D 85/04* (2013.01); *B65D 1/16* (2013.01); *B65D 71/0092* (2013.01);
(Continued)

(58) Field of Classification Search
CPC ..... B65D 1/16; B65D 71/00; B65D 71/0092; B65D 71/0096; B65D 85/04;
(Continued)

(56) References Cited

U.S. PATENT DOCUMENTS 1,905,488 A 4/1933 Nack
4,253,570 A 3/1981 O'Connor et al.
(Continued)

FOREIGN PATENT DOCUMENTS

EP 0480259 A1 * 4/1992 ..... B65D 85/04
EP 2492214 A1 * 8/2012 ..... B65D 85/04
GB 828640 A * 2/1960 ..... B65D 85/04

*Primary Examiner* — Bryon P Gehman
(74) *Attorney, Agent, or Firm* — Howson & Howson LLP

(57) ABSTRACT

A drum for storage or transportation of a coil, comprises a base configured to rest on a horizontal surface. A hollow polygonal core extends upward from the top of the base. A cover also extends from the top of the base and has a circular, cylindrical, inner wall. The cover is spaced from the core, forming an annular space for receiving a coil. The core is composed of a plurality of planar parts hinged to one another so that the core can be collapsed and stored or shipped in a substantially flat condition, and expanded to its polygonal shape for connection to the base. The cover is composed of two or more arc-shaped parts, which are capable of being nested for storage and shipment. The drum
(Continued)

can be used for storage or transportation of dry bulk material, in which case the core can be eliminated.

10 Claims, 12 Drawing Sheets

(51) Int. Cl.
*B65H 49/38* (2006.01)
*B65D 1/16* (2006.01)

(52) U.S. Cl.
CPC ..... *B65D 71/0096* (2013.01); *B65H 49/38* (2013.01); *B65D 2571/00061* (2013.01)

(58) Field of Classification Search
CPC ..... B65D 2571/00061; B65H 49/38; B65H 75/18; B65H 75/22; B65H 75/24; B65H 75/141
USPC ..... 206/408, 409
See application file for complete search history.

(56) References Cited

U.S. PATENT DOCUMENTS

| | | | | |
|---|---|---|---|---|
| 7,306,100 | B1 | 12/2007 | Eslambolchi et al. | |
| 7,353,947 | B2 * | 4/2008 | Weissbrod | B65D 71/0088 206/389 |
| 7,377,388 | B2 * | 5/2008 | Hsu | B65D 85/04 206/408 |
| 7,497,332 | B1 | 3/2009 | Schwimmer | |
| 7,828,242 | B2 * | 11/2010 | Snitselaar | B65H 75/22 242/609.1 |
| 8,851,413 | B2 * | 10/2014 | Phillips | B65H 75/14 242/609.1 |
| 2005/0051664 | A1 | 3/2005 | Maxwell et al. | |
| 2009/0084887 | A1 | 4/2009 | Aiston et al. | |
| 2010/0025521 | A1 | 2/2010 | Snitselaar | |
| 2011/0253830 | A1 | 10/2011 | Witwer et al. | |
| 2013/0082132 | A1 * | 4/2013 | Gaul | B65D 19/20 242/171 |

* cited by examiner

DRUM FOR STORAGE AND TRANSPORTATION OF ARTICLES AND MATERIALS

CROSS-REFERENCE TO RELATED APPLICATIONS

This application incorporates by reference the entire disclosure of U.S. Provisional Patent Application 62/153,056, filed Apr. 27, 2015, and claims priority on the basis of said provisional patent application.

FIELD OF THE INVENTION

This invention relates to the storage and transportation of articles such as cables, and materials such as dry bulk products. The invention relates more particularly to drums for use in the storage and transportation, which include protective covers, and which can be readily assembled from components capable of being nested in a small space, and readily disassembled.

BACKGROUND OF THE INVENTION

Cables and tubing are conventionally wound as coils on reels for storage and transportation. In some cases, the reels are incorporated into drums that enclose and protect the coils. The reels and drums used for these purposes have been provided in many forms. Some reels are composed of a cylindrical core having circular flanges permanently attached at both of its ends. Other reels, such as the reels described in U.S. Pat. No. 6,913,222, granted on Jul. 5, 2005 and U.S. Pat. No. 8,424,796, granted on Apr. 23, 2013, are composed of parts that can be transported separately from one another, assembled to form a drum, and later disassembled for storage and re-use.

In many cases, it is desirable to transport cable or tubing using a drum having not only a core but also an external cover for protection of the cable or tubing during transport. In such a drum, the cable or tubing can be coiled within an annular space between the core and the external cover. Although an external cover is frequently desirable for protection of cable or tubing, a drum composed of a core, an external cover, and one or more flanges is not readily assembled and disassembled, and when these drum components are disassembled, they are not readily stored in a compact form. There is a need for a drum, having a core and an external cover, that is simple to manufacture, light in weight, easy to assemble and disassemble, sufficiently strong to withstand impact, and composed of elements that can be readily stored in a small space when disassembled, and that can be transported easily in a disassembled condition.

SUMMARY OF THE INVENTION

A drum in accordance with one aspect of the invention comprises as its principal components a base, a core, and an outer cover.

The base has a bottom side for resting on a planar horizontal surface, and a wall extending in an upward direction from the bottom side of the base when the bottom side is resting on the horizontal surface. The wall has an outer surface that is preferably in the form of a circular cylinder, and an inner surface, preferably having a polygonal cross-sectional shape, with plural faces and vertices disposed in an imaginary circular cylinder coaxial with the circular cylindrical outer surface of the wall. (The terms "cylinder" and "cylindrical" as used herein refer to a surface generated by movement of a straight line in a closed path in directions perpendicular to its length while maintaining the line parallel to a fixed reference line.)

The wall includes plural inward protrusions, and in the case of a polygonal inner wall, each of the inward protrusions extends inward from one of the plural faces of the inner surface of the wall.

An elongated, preferably hollow, cylindrical core fits the inner surface of the base and extends from the base in the upward direction. The core preferably has an outer surface the horizontal cross-sections of which, i.e., the cross-sections in imaginary planes transverse to the upward direction, have the same polygonal shape as that of the inner surface of the wall of the base, and an end portion conforming to and fitting the polygonal inner surface of the wall. Slots in the core receive the inward protrusions on the wall.

A hollow, preferably cylindrical, cover also extends from the base in the upward direction. The cover is composed of plural parts, each having an inner surface with concave, curved, preferably arcuate, cross-sections in imaginary planes transverse to the upward direction. The cover parts are connected to one another so that their inner surfaces form a wall surrounding and spaced radially outward from the core, providing an annular space between the cover and the core. The core, the cover, and a portion of the base extending across the annular space from the core to the cover, form a receptacle capable of receiving a coil or other material.

Preferably, the cover is composed of two parts, each having an inner surface with semi-circular cross-sections in imaginary planes transverse to the upward direction. These two parts are connected to each other so that the inner surfaces of the two parts form a circular, cylindrical inner wall. The parts of the cover can be secured together by the use of elongated clamps that slide onto flanges formed on the edges of the cover parts. In this case, each of the elongated clamps has an upper end and a lower end, an interior space extending from the upper end to said lower end, and a slot providing an opening to the interior space, the opening also extending from the upper end to the lower end. The opening of each elongated clamp receives a pair of outward protruding flanges at a pair of meeting edges of the plural parts of the cover and maintains the meeting edges in fixed relationship to each other.

In addition, the base is preferably formed with an annular, radially outward-protruding flange, which is receivable in arc-shaped recesses formed at the lower ends of the cover parts. These arc-shaped recesses are located within outwardly protruding arc-shaped parts formed adjacent the lower ends of the cover. When the cover parts are engaged with the base, the outwardly protruding arcs meet at their ends, forming an annular flange to which a metal band having a toggle action latch can be fitted to secure the cover parts to the base. If an upper end closure is provided at the upper end of the drum, the upper end closure can also be formed with an annular radially outward-protruding flange similar to the outward protruding flange of the base. The outwardly protruding flange of the closure can be fitted into arc-shaped recesses located within outwardly protruding arc-shaped parts formed adjacent the upper ends of the cover, and another metal band having a toggle action latch can be used to secure the cover parts to the upper end closure.

Alternatively the parts of the cover can be secured together by the use of zip ties that extend through slots in vertical flanges formed on the edges of the cover parts. The core preferably comprises a plurality of planar walls hinged to one another so that the core can be stored in a substantially flat condition and expanded to a polygonal shape conforming to the polygonal shape of an inner surface of the base.

In an embodiment of the drum adapted to be lifted or transported by a fork lift, the circular cylindrical outer surface of the base extends upward from a level spaced vertically upward from the bottom side of the base when said bottom side is resting on a planar horizontal surface, and the base has an annular recess below the level from which the outer surface of the base extends upward. This annular recess can receive blades of a fork lift. The base has an overhanging surface above the recess for engagement by forklift blades so that the drum can be raised and transported.

DETAILED DESCRIPTION OF THE PREFERRED EMBODIMENTS

Figure 1:
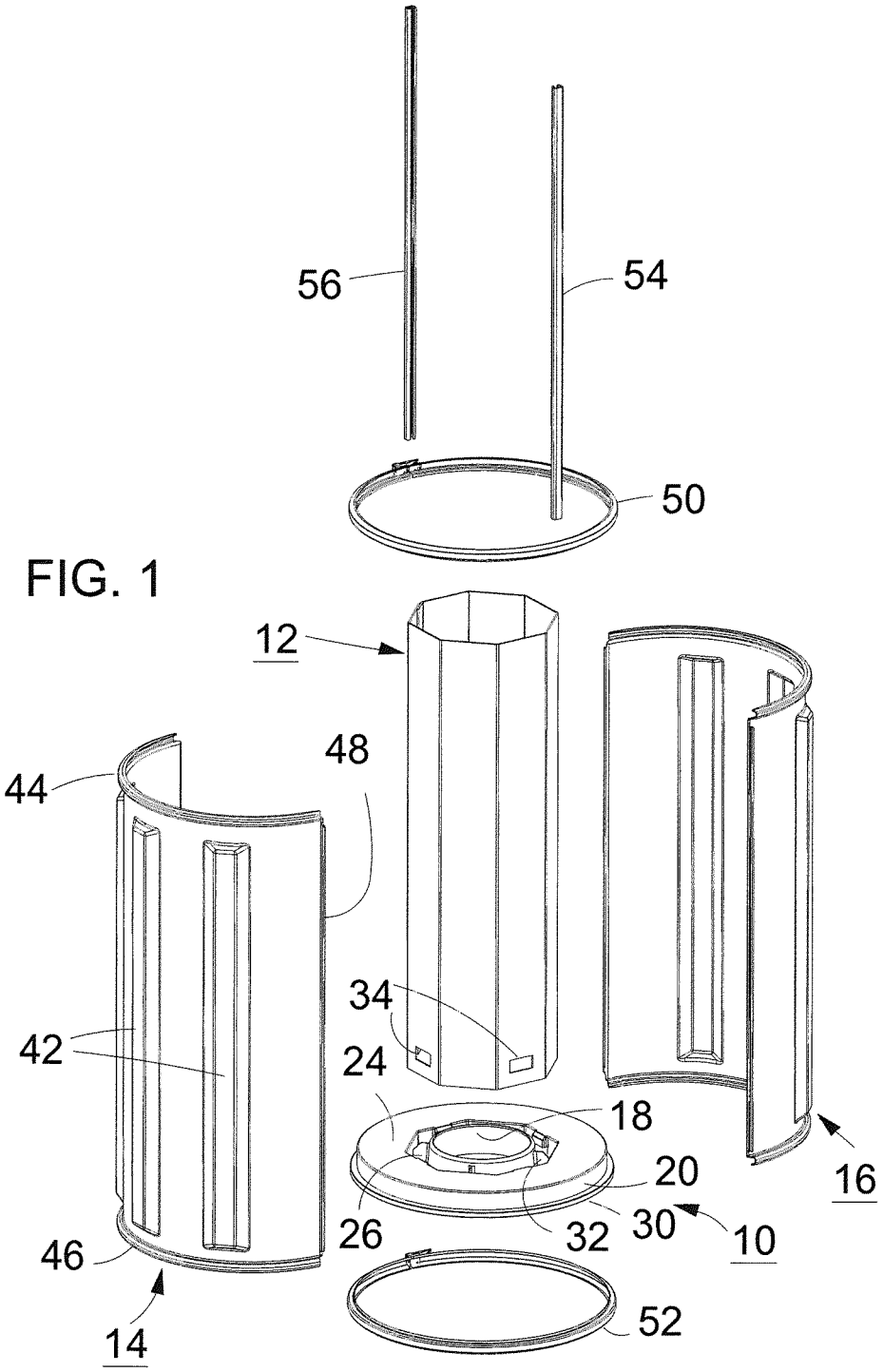
FIG. 1 is an exploded perspective view of the principal components of the drum, namely a base, a polygonal core, a pair of semicircular cover parts, a pair of clamping rings, and a pair of elongated clamps.
Figure 2:
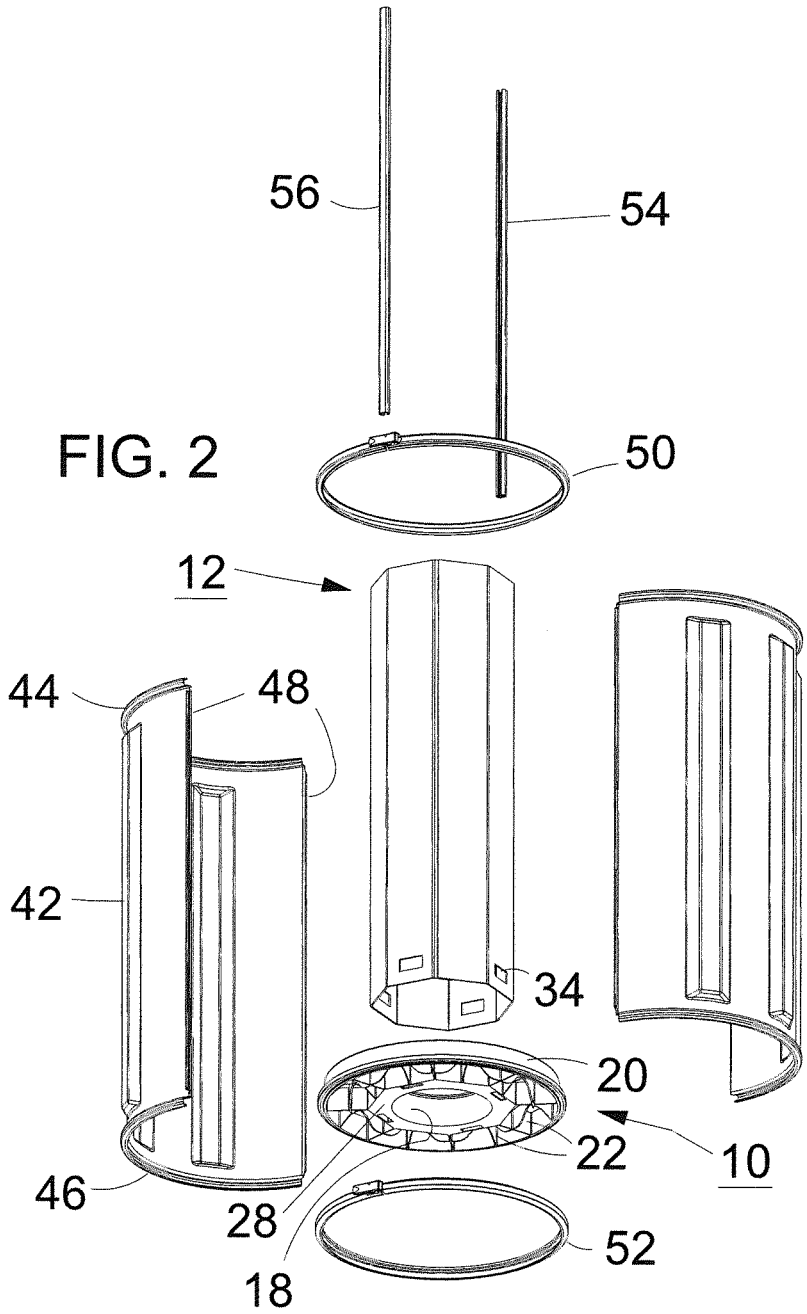
FIG. 2 is second exploded perspective view of the principal components of the drum, showing the underside of the base.

As shown in FIGS. 1 and 2, the principal components of a preferred embodiment of the drum according to the invention are the base 10, the core 12, and a cover comprising two parts 14 and 16. The two parts come together to form an outer cover which cooperates with the core and the base to form a receptacle having an annular interior space for containing a coil of flexible cable, tubing, or the like. The base and the cover can be composed of any of a wide variety of materials, and can be molded from any of various engineering plastics having suitable strength, resilience, and heat and impact resistance. Examples of suitable materials are high density polyethylene, acrylonitrile butadiene styrene (ABS), and poly (vinyl chloride) (PVC). The core is preferably composed of cardboard, but can also be made from other materials such as plastics.

As shown in FIGS. 1 and 2, the preferred base 10 is a unitary molded part comprising coaxial inner and outer circular parts 18 and 20. The parts 18 and 20 are connected by a plurality of radially extending ribs 22 shown in FIG. 2. A planar top surface 24 of the base is formed with an octagonal recess 26 for receiving the core 12. This recess has a bottom wall 28, shown in FIG. 2. A circular flange 30 extends outward from the lower edge of part 20. The bottom of the flange 30 and the underside of the bottom wall 28 of the octagonal recess are coplanar so that both can simultaneously contact a floor or other horizontal supporting surface.

The planar top surface 24 of the base forms the bottom of an annular interior space when the drum is in an assembled condition. The vertices of the octagon forming the boundary of the octagonal recess 26 are disposed in an imaginary circular cylinder coaxial with the outer surface of part 20. The recess 26 has eight wall surfaces, each in the form of a plane that is vertical when the flange 30 and the underside of the bottom wall 28 are horizontal. Protrusions 32 extend horizontally inward from alternate ones of the eight walls of the octagonal recess. These protrusions cooperate with slots 34 in the core 12 to hold the core in place.

Figure 3:
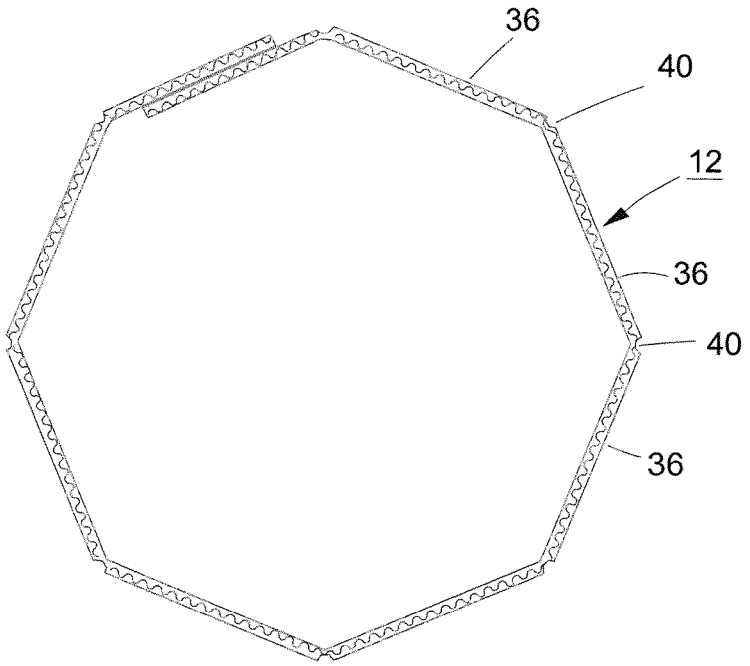
FIG. 3 is a cross-sectional view showing the polygonal core in its expanded condition.
Figure 4:
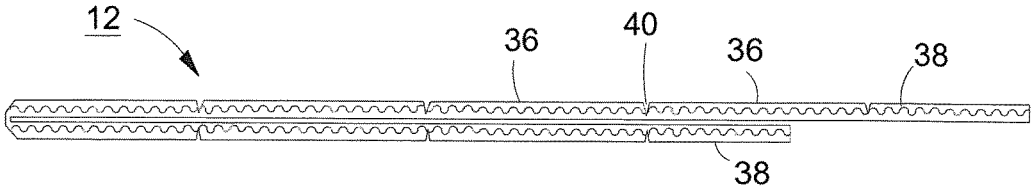
FIG. 4 is a cross-sectional view showing the core in its flattened condition.

The core 12, shown in cross-section in FIG. 3, has the same polygonal cross-sectional shape as that of the octagonal wall of recess 26 in the base, and conforms to wall of the recess when the core is inserted into the recess. The core is composed of seven elongated, planar panels 36 which form walls of the core, and two additional panels 38, which overlap as shown in FIG. 3 to form an eighth wall of the core. The panels are joined to one another by elongated, narrowed portions 40 of the core structure that form hinges, allowing the core to be deformed from its regular polygonal shape as shown in FIG. 3 to a substantially flat condition, e.g., the condition shown in FIG. 4 for storage or transport. The core is preferably formed from a stiff corrugated paper board or a similar material, but, alternatively, it can be formed from a synthetic resin, or from any of various other materials.

As shown in FIGS. 1 and 2, the slots 34, are located adjacent the bottom ends of alternate core panels 36. These slots are engaged by protrusions 32 when the core is disposed in the recess to hold the core in place.

Cover part 14 has semicircular cylindrical inner and outer surfaces, and is formed with outwardly protruding elongated ribs 42 for stiffness. Outwardly protruding semicircular flanges 44 and 46 are formed at the upper and lower edges of the cover part, and outwardly protruding flanges 48 are formed on its vertical edges. Preferably, cover part 16 is identical to cover part 14.

FIGS. 1 and 2 also show upper and lower clamping rings 50 and 52 for engagement with the semicircular flanges at the upper and lower ends of the cover parts, and elongated clamps 54 and 56 for sliding engagement with the flanges on the vertical edges of the cover parts.

Figure 5:
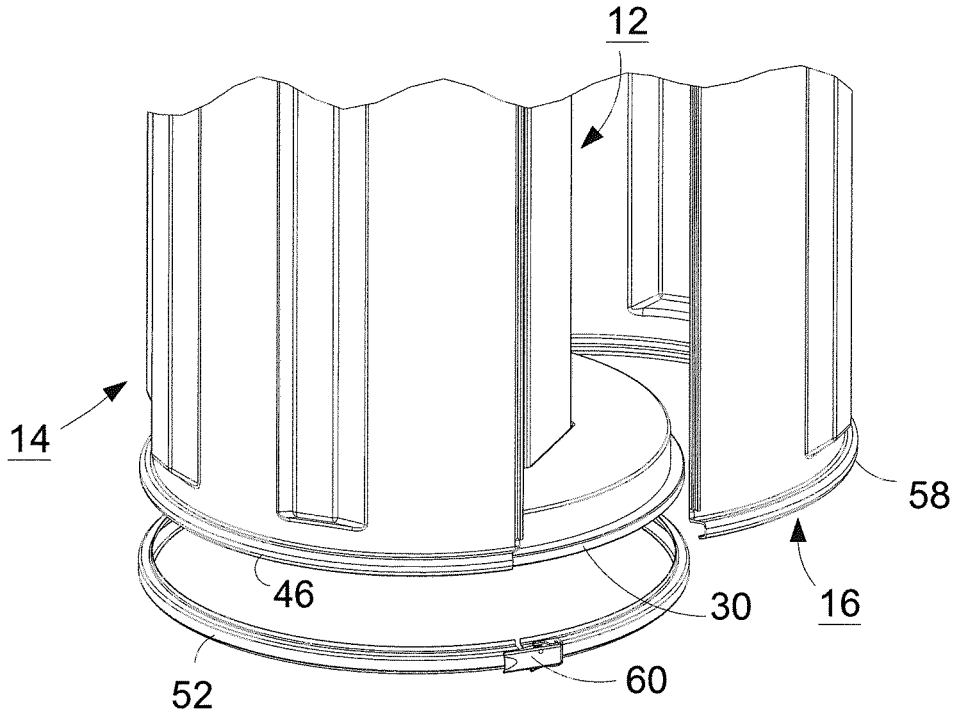
FIG. 5 is a fragmentary exploded perspective view illustrating the process of attachment of a semicircular cover part to the base of the drum.

As shown in FIG. 5, the outwardly protruding semicircular flange 58 on cover part 16 has a concave inner surface for receiving flange 30 of the base. Flange 46 on cover part 14 has a similar concave inner surface. FIG. 5 shows cover part 14 engaged with the base 10, and cover part 16 approaching engagement with base 10 and with cover part 14. When in place, the cover parts are secured to each other by fitting clamping rings 50 and 52 to the joined semicircular flanges at the upper and lower edges of the cover parts, and by fitting elongated sliding clamps 54 and 56 to the outwardly protruding flanges formed along the vertical edges of the cover parts. As shown in FIG. 5, clamping ring 52 is provided with a conventional toggle latch 60, which allows the clamping ring to be expanded sufficiently to be fitted onto the joined flanges of the cover parts and to be contracted so that it firmly secures the cover parts to the flange on the base and to each other.

Figure 6:
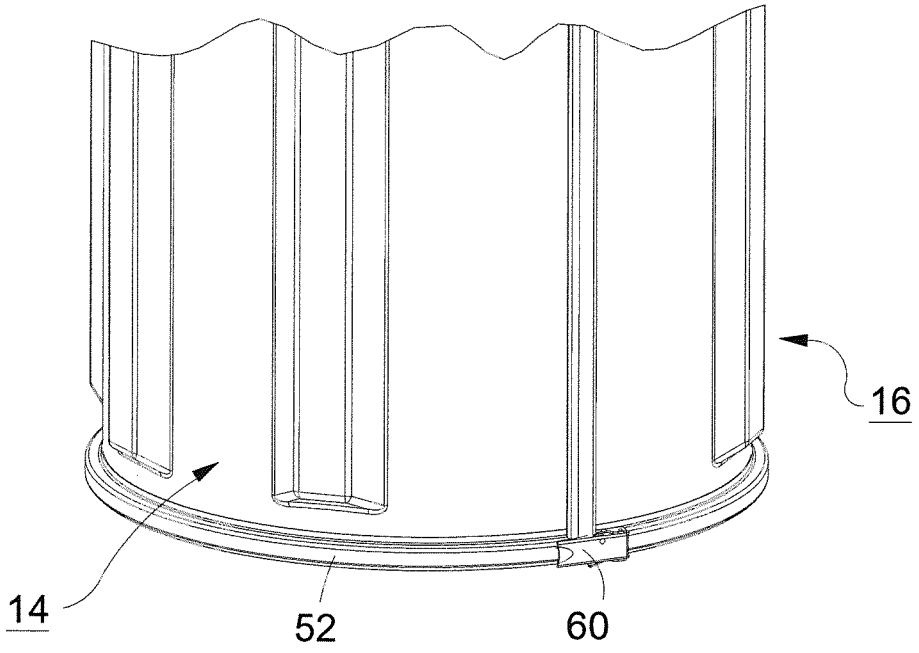
FIG. 6 is a fragmentary perspective view illustrating the use a lower clamping ring to secure the two semicircular cover parts to the base.
Figure 7:
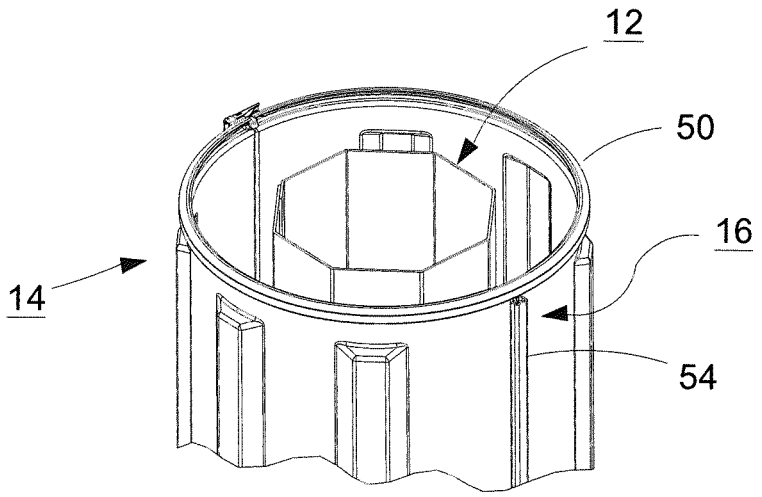
FIG. 7 is a fragmentary perspective view showing the semicircular cover parts secured to each other at their upper ends by an upper clamping ring and along their vertical edges by elongated sliding clamps.

FIG. 6 shows the cover parts 14 and 16 held together at their lower ends by clamping ring 52, and FIG. 7 shows the cover parts held together at their upper ends by clamping ring 50. FIG. 7 also shows elongated sliding clamp 54 in engagement with flanges formed on the adjoining vertical edges of the cover parts 14 and 16.

Figure 8:
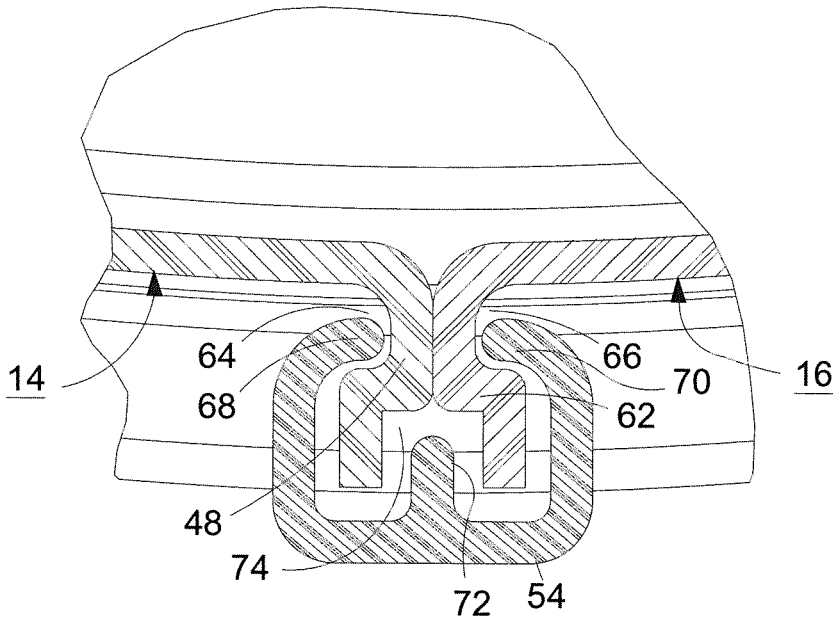
FIG. 8 is a cross-sectional view illustrating details of the relationship between the sliding clamps of FIGS. 1 and 2 and the flanges formed on the vertical edges of the cover parts.

As shown in FIG. 8, elongated vertical flanges 48 and 62 protrude outward from edges of cover parts 14 and 16, respectively. The sliding clamp 54 is generally C-shaped as shown, and vertical flanges 48 and 52 of the cover parts are S-shaped flanges in horizontal cross-section. Thus, the flanges have intermediate parts that extend circumferentially in opposite directions, forming oppositely facing recesses 64 and 66 for receiving opposed edges 68 and 70 of sliding clamp 54. The sliding clamp is also preferably formed with an internal rib 72, which fits into a space between the outer parts of the S-shaped flanges 48 and 52. Because of the S-shape of flanges 48 and 52 and the presence of the internal rib 72 in the sliding clamp, it is possible to increase the size of the sliding clamp, making it easier to manipulate and also stronger. The sliding clamp can be a plastic extrusion.

Elongated sliding clamp 56 (FIGS. 1 and 2) on the opposite side of the cover is similar to clamp 54. The elongated sliding clamps are removably slidable onto the flanges, and held in place by friction, taking advantage of inherent resilience of the clamp material, the cover part material, or both. The clamps maintain the adjoining edges of the cover parts in fixed relationship to each other. The cover parts can be readily separated for disassembly by removal of the upper and lower clamping rings and sliding the elongated clamps off the flanges.

The clamps can be composed of any of various materials, including the aforementioned engineering plastics, or a metal such as aluminum.

Figure 9:
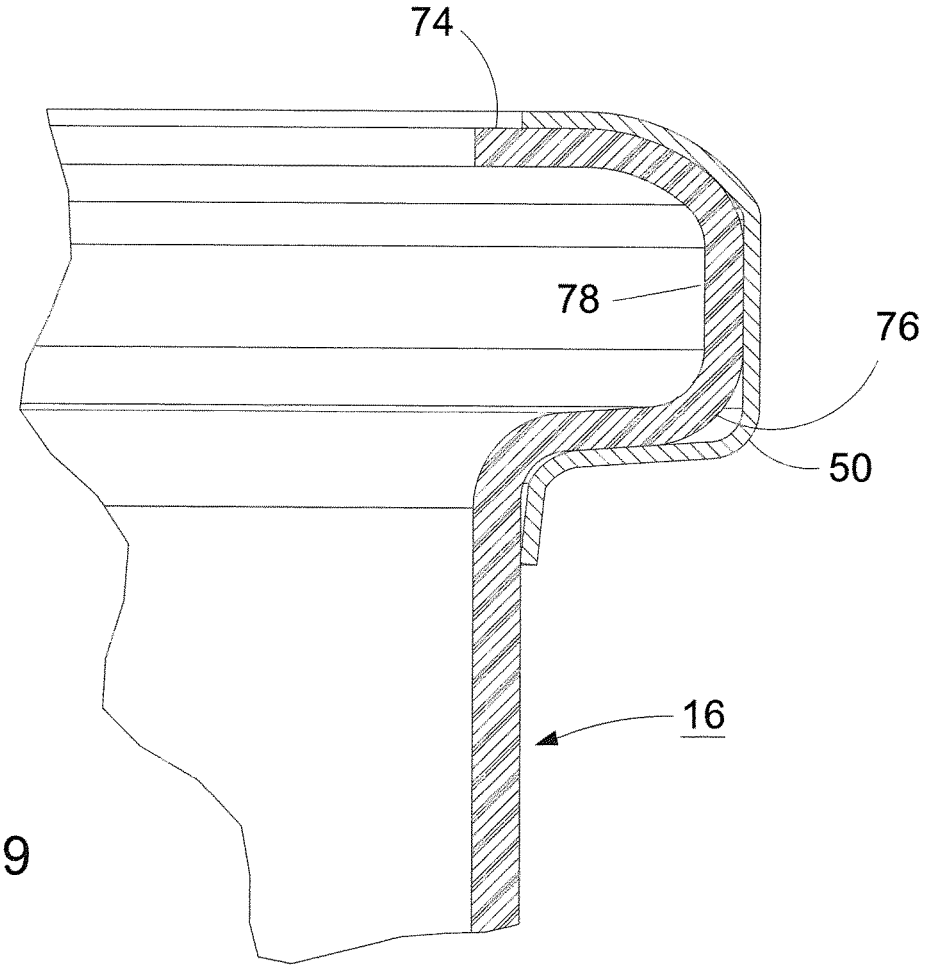
FIG. 9 is a fragmentary cross-sectional view showing in greater detail the relationship between the upper end of a semicircular cover part and an upper clamping ring.

FIG. 9 shows the upper flange 74 of cover part 16. The shape of the upper flange 74 is preferably identical to that of the lower flange, and in fact the cover parts can be symmetrical about an imaginary centrally located horizontal plane so that none of the cover parts needs to be turned upside-down in the process of assembly of the drum. The outer surface 76 of the flange fits the recess of the clamping ring 50, and the recessed inner surface can fit a drum lid (not shown) if one is used.

Figure 10:
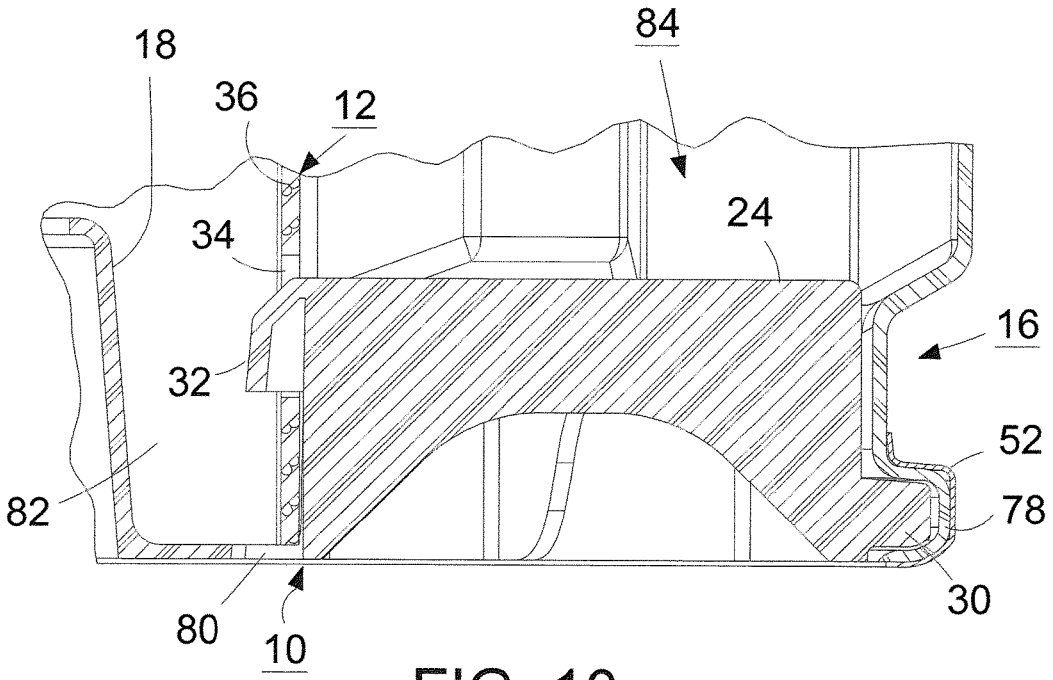
FIG. 10 is a cross-sectional view, taken on an imaginary vertical plane through a portion of the base, illustrating the engagement of the core and one of the semicircular cover parts with the base.

The cross-sectional view in FIG. 10 shows the lower clamping ring in engagement with a flange 78 of cover part 16, which in turn receives flange 30 of the base 10. This figure also shows a protrusion 32 of the base extending through a slot 34 in one of the panels 36 of core 12. An opening 80 is provided at the bottom of the octagonal recess in the base for insertion of a prying tool that can be used to bend the core panels, to release them from the protrusions 32. Panels such as panel 82, which extend radially outward from inner circular part 18 of the base, are spaced from the faces of the octagonal recess by a distance such that they maintain the core in engagement with the core-retaining protrusions 32 and preferably so that they maintain the core panels in contact with the faces of the octagonal recess.

Space 82 is the annular space, between the core and the cover and above top surface 24 of the base, within which a coiled cable or coiled length of tubing can be contained.

Figure 11:
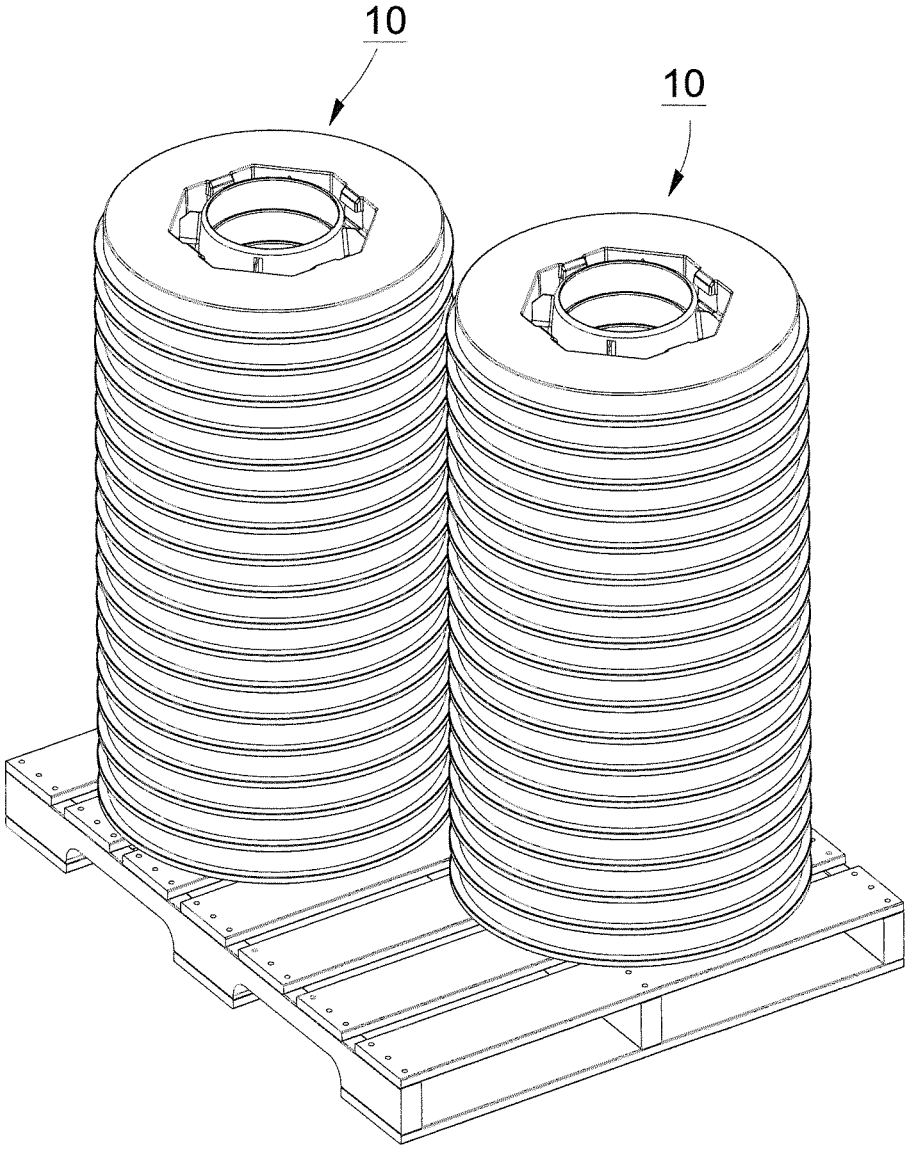
FIG. 11 is a perspective view showing bases nested on one another on a pallet.
Figure 12:
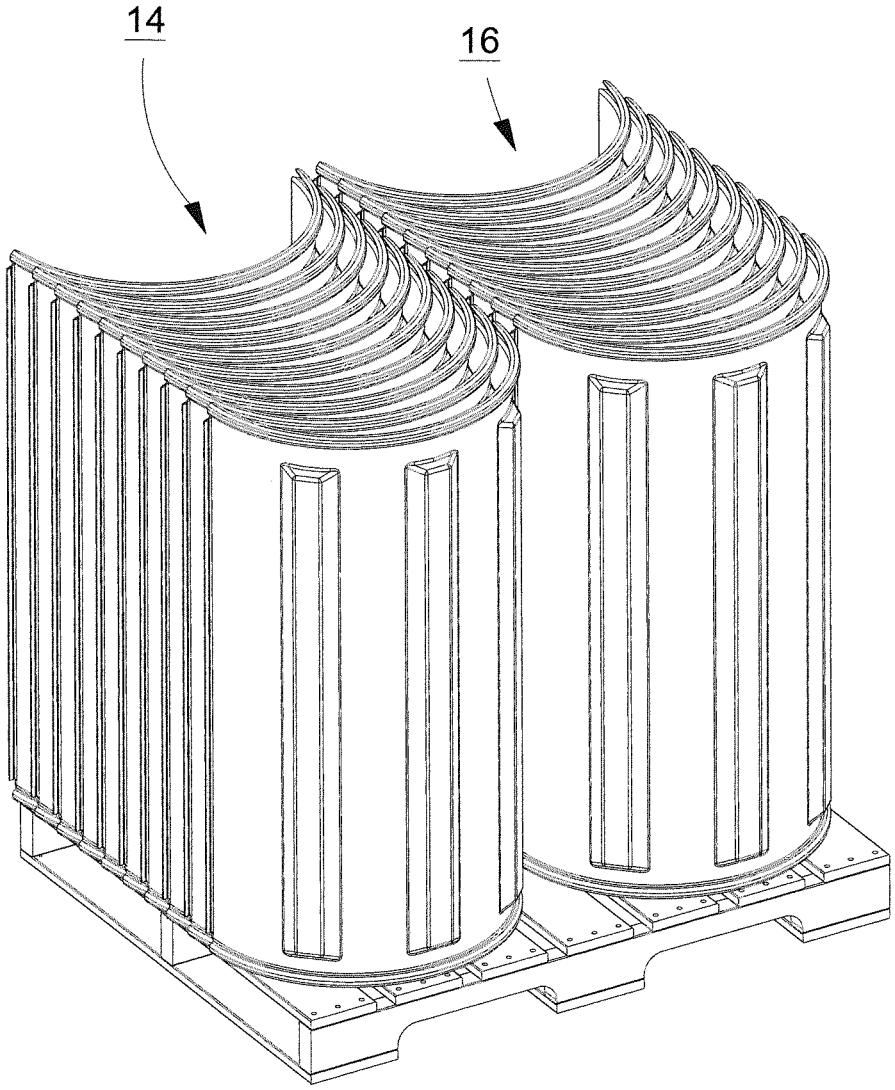
FIG. 12 is a perspective view showing semicircular cover parts nested on a pallet.
Figure 13:
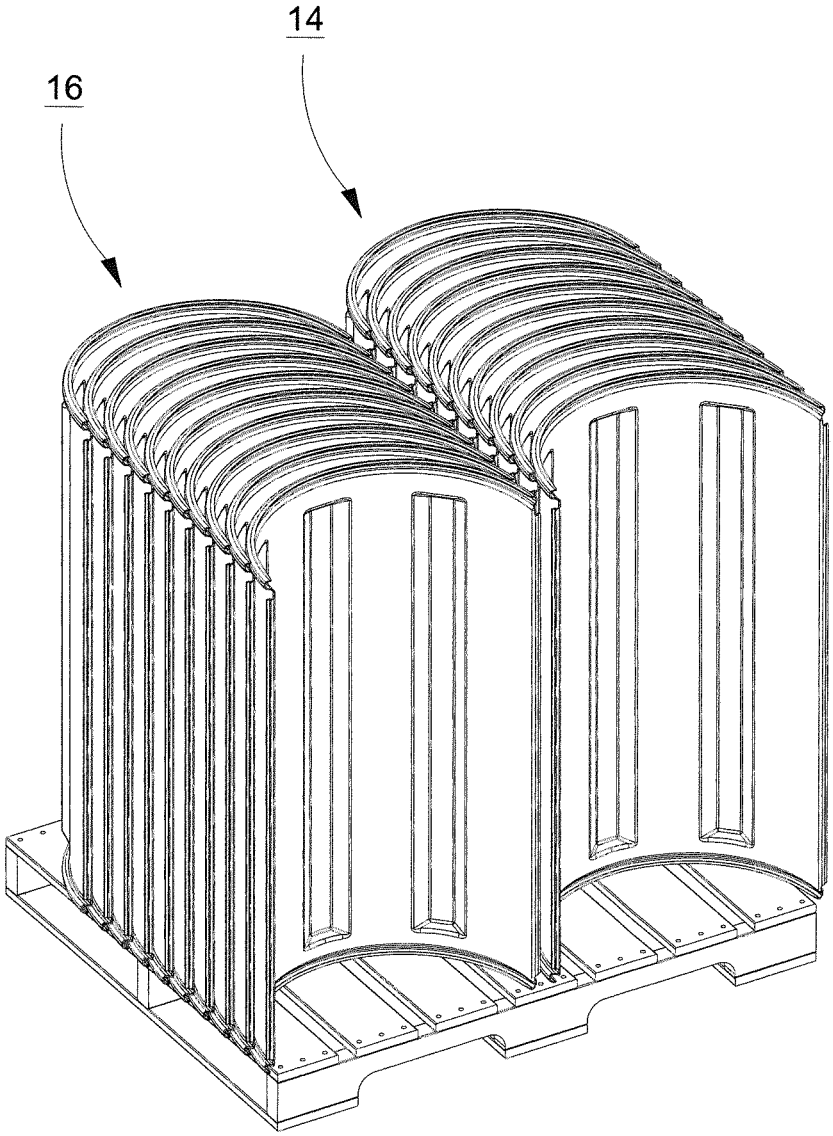
FIG. 13 is another perspective view showing the semicircular cover parts nested on a pallet.

The bases 10 can be stacked for transportation and storage, and as illustrated in FIG. 11, two stacks of bases can be placed on a conventional forklift pallet. The semicircular cylindrical cover parts can be nested with one another and also placed on a forklift pallet as illustrated in FIGS. 12 and 13. In this instance, the cover parts are nested while in a vertically extending condition.

Figure 14:
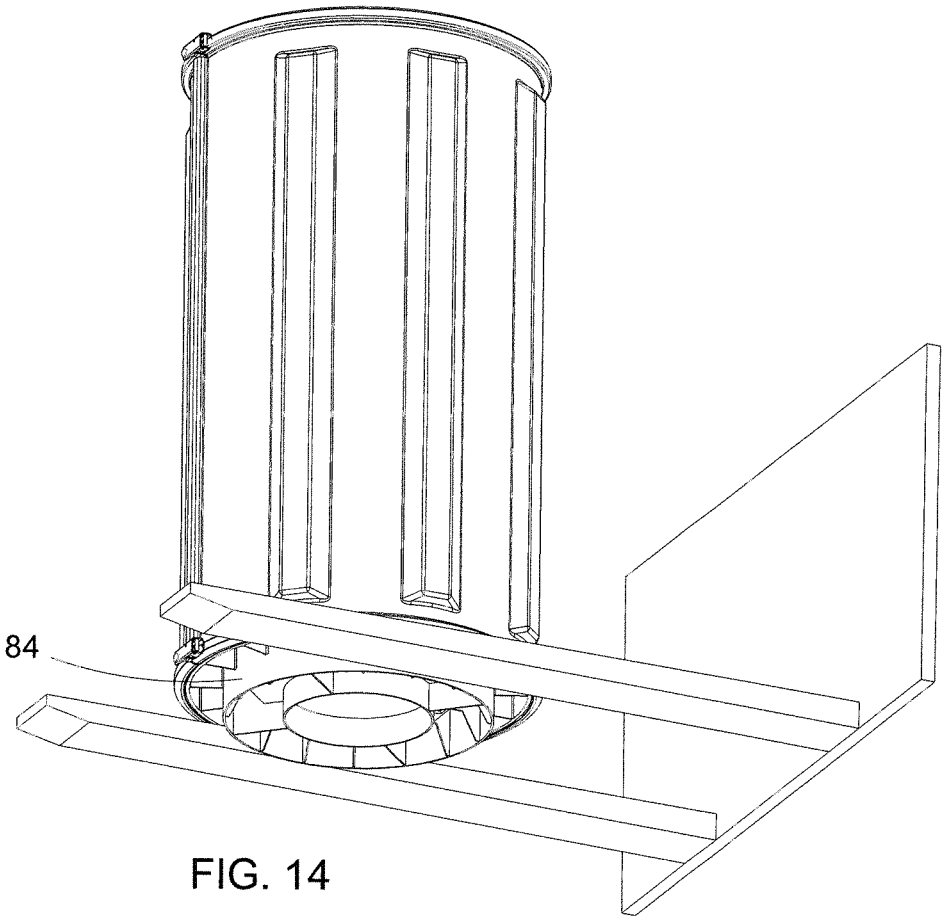
FIG. 14 is a perspective view of an assembled drum having a modified base, showing engagement of a modified base with the blades of a forklift.

FIG. 14 illustrates an alternative form of drum in which a circular inner part 84 of the base extends a short distance downward below the level of the outer flange of the base, providing space on both sides to receive the blades 86 of a fork lift. The fork lift blades can then engage an overhanging surface of the base. In this case, the diameter of the circular inner part 84 should be small enough to fit between the fork lift blades 86, but otherwise as large as possible so that the drum is stable when resting on a horizontal surface.

As will be apparent from the above description, a covered drum can be assembled readily by placing a base on a horizontal surface, shaping a core into a regular polygonal shape and inserting it into the polygonal recess of the base, engaging its panels with the inward protrusions in the recess, then attaching the two semicircular cylindrical cover parts to each other and to the base, using the elongated sliding clamps, and then applying the upper and lower clamping rings to the cover parts Cable or tubing can be wound onto the core before placement of the cover parts, or alternatively introduced through the annular opening at the top of the drum and simultaneously wound about the core.

Disassembly of the drum can be accomplished by removing the clamping rings and sliding the elongated clamps off the vertical flanges of the cover parts, removing the cover parts, prying the core from the inward protrusions on the inside faces of the base wall and removing the core. The base and cover parts can be nested with other bases and cover parts for storage and later reused. The core can also be brought to a flattened condition and stored along with other cores for reuse.

The base and the cover parts can be produced by molding, and can be light in weight so that the drum can be assembled and disassembled easily by a single individual.

Various modifications can be made to the drum described above. For example, although the core in the embodiment shown and described has eight faces, the number of core faces can vary. For example, a hexagonal core can be used effectively. Similarly, while the cover is composed of two semicircular cover parts, alternatively the cover can be composed of three or more arcuate parts that, when assembled, form a complete circular cylinder.

In another modification, an upper end lid (not shown) can be fitted to the upper end of the drum structure to complete the closure of the annular space between the core and the cylindrical cover and to serve as a dust cap. A simple circular element that fits into the annular groove formed by the flanges at the in the upper ends of the cover parts can be used.

Base configurations other than the one shown in FIG. 14 can be utilized to accommodate fork lifts and other devices for transportation of the drum. For example, the base can be provided with plural feet in various configurations.

Cables to be stored and transported can include single-conductor or multiple-conductor electrical cables for communication or electric power transmission, coaxial cables, optical fiber cables, and multi-strand hoisting cables, as well as hollow tubing for uses such as carrying fluids or for use as electrical conduit and many other kinds of cables. Among the advantages of the drum described above is the fact that, in addition to its light weight, ease of assembly and disassembly, and compact storage of its parts, it can be utilized for purposes other than storage and transport of coils. For example, if the drum is no longer needed for containing a coil of wire, cable, tubing or the like, the core can be removed and the drum can be utilized as a container for any of various dry bulk products such as pelletized plastics, chlorinated polyethylene or rubber, color concentrates in chopped or pelletized form, dry blend resins, sugar, other powdered materials such as baking products, nuts and spices, and even hardware such as bolts and nuts and machined parts. For storage and transport of bulk products, a suitable bottom insert should be provided, and in some cases, a plastic liner should be used.

What is claimed is:

1. A drum for storage and transportation of a coil or dry bulk material, the drum comprising:

a base; and a hollow cover extending from the base in an upward direction, said cover being composed of plural parts, connected to one another;

in which each of said plural parts of the cover has two opposite edges, each of said opposite edges extending in an upward direction, each of said edges of each of said plural parts meets an edge of an adjacent one of said plural parts, thereby forming a pair of meeting edges, and each of said edges is formed with an outward protruding flange whereby two flanges protrude outward from each location at which edges of said plural parts meet; and in which said drum further comprises a plurality of elongated clamps, each of said elongated clamps having an upper end and a lower end, an interior space extending from said upper end to said lower end, a slot providing an opening to said interior space, said opening also extending from said upper end to said lower end, said opening of each said elongated clamp receiving a pair of said outward protruding flanges at a pair of meeting edges of said plural parts of the cover, whereby the elongated clamp having said opening maintains said meeting edges in fixed relationship to each other.

2. A drum according to claim 1, in which each of said elongated clamps is removably slidable on said outward protruding flanges in an upward direction.

3. A drum according to claim 1, in which said cover extends circumferentially, the outward protruding flanges at each pair of said meeting edges include flange parts extending in opposite circumferential directions, the interior space of each said clamp is circumferentially larger than the width of the slot thereof, said flange parts at each pair of meeting edges are disposed within said interior space of an elongated clamp and occupy a portion of said interior space of said elongated clamp circumferentially wider than the width of the slot thereof.

4. A drum according to claim 3, in which each of said elongated clamps is removably slidable on said outward protruding flanges in an upward direction.

5. A drum according to claim 1, in which:

said base has a bottom side for resting on a planar horizontal surface, a wall extending in an upward direction from said bottom side of the base when said bottom side is resting on the horizontal surface, said wall having an inner surface, and a plurality of protrusions extending radially inward from said inner surface;

said drum includes an elongated core fitting said inner surface of the wall of the base and extending from the base in the upward direction, and slots in said core receiving said inward protrusions; and said inner surface of the wall of the base has a polygonal shape, said elongated core has the same polygonal shape as that of the inner surface of the wall of the base, and said core is composed of a plurality of substantially planar parts hinged to one another whereby the core is capable of being stored and shipped in a substantially flat condition and expanded to said polygonal shape for connection to said base.

6. A drum according to claim 1, in which said base has a bottom side for resting on a planar horizontal surface, a wall extending in an upward direction from said bottom side of the base when said bottom side is resting on a planar horizontal surface, and an overhanging surface, spaced upward from said bottom side of the base, for engagement by the blades of a fork lift, whereby the drum can be raised and transported by engagement of the blades of a forklift with said overhanging surface.

7. A drum according to claim 1, in which each of said plural parts of the hollow cover has an inner surface with curved cross-sections in imaginary planes transverse to the upward direction in which said hollow cover extends, said parts being connected to one another so that the inner surfaces of said parts form a cylindrical inner wall.

8. A drum according to claim 1 in which each of said plural parts of the cover has an inner surface, and in which the cross-section of the inner surface of each of said plural parts of the cover is arcuate in imaginary planes transverse to the upward direction in which said hollow cover extends.

9. A drum according to claim 1, in which said hollow cover is composed of two parts, each having an inner surface with semi-circular cross-sections in imaginary planes transverse to said upward direction, said two parts being connected to each other so that the inner surfaces of said two parts form a circular, cylindrical inner wall.

10. A drum according to claim 1, in which said base has a bottom side for resting on a planar horizontal surface, and an inner wall having a polygonal inner surface;

said drum includes an elongated core fitting said inner surface of the wall of the base and extending from the base in the upward direction; and said core comprises a plurality of planar walls hinged to one another, whereby the core can be stored in a substantially flat condition, and expanded to a polygonal shape conforming to the polygonal shape of said inner surface of the base.

* * * * *